US006006579A

United States Patent [19]

Iseri et al.

[11] Patent Number: 6,006,579

[45] Date of Patent: Dec. 28, 1999

[54] METHOD OF FABRICATING SHAFT FROM METAL PLATE

[75] Inventors: Mitsuhiro Iseri, Moriguchi; Kazuaki Hayashizaki; Yutaka Hino, both of Yokohama, all of Japan

[73] Assignee: Matsushita Electric Industrial Co., Ltd., Osaka, Japan

[21] Appl. No.: 09/147,557

[22] PCT Filed: Sep. 6, 1996

[86] PCT No.: PCT/JP96/02536

§ 371 Date: Jan. 20, 1999

§ 102(e) Date: Jan. 20, 1999

[87] PCT Pub. No.: WO98/09749

PCT Pub. Date: Mar. 12, 1998

[51] Int. Cl.[6] ..... B21C 37/02; B21C 23/18

[52] U.S. Cl. ..... 72/379.2; 72/356; 72/267; 72/334

[58] Field of Search ..... 72/356, 358, 352, 72/359, 267, 256, 334, 379.2

[56] References Cited

U.S. PATENT DOCUMENTS

| | | | |
|---|---|---|---|
| 1,048,046 | 12/1912 | Currey | 72/334 |
| 2,427,756 | 9/1947 | West | 72/379.2 |
| 3,387,481 | 6/1968 | Harvey | 72/256 |
| 4,368,634 | 1/1983 | Brown | 72/267 |

FOREIGN PATENT DOCUMENTS

| | | | |
|---|---|---|---|
| 764459 | 5/1934 | France | 72/356 |
| 50-117674 | 9/1975 | Japan . | |
| 57-22841 | 2/1982 | Japan . | |
| 59-87946 | 5/1984 | Japan . | |
| 205844 | 8/1989 | Japan | 72/334 |
| 4-127930 | 4/1992 | Japan . | |
| 970247 | 8/1958 | United Kingdom | 72/256 |

*Primary Examiner*—Daniel C. Crane
*Attorney, Agent, or Firm*—McDermott, Will & Emery

[57] ABSTRACT

A method of forming integrally an axis on a metallic plate at an arbitrary position thereof and perpendicular to a surface thereof. A first surface of the metallic plate is place on a first die having a first diameter opening and a second surface of the metallic plate, opposing the first surface, is pressed with a first punch to form a projection from the first surface via half blanking or forward squeezing. The projection has a tip surface extending into the first diameter opening a first distance from the first surface. The first surface of the metallic plate is then placed on a second die having a depression with the projection extending into the depression. The depression has a second diameter and a depth distance greater than the first distance. The second surface of the metallic plate is then contacted with a second punch causing the tip surface of the projection to contact a bottom surface of the depression and form the axial projection via rear-squeezing. The axial projection has a tip surface extending a second distance from the first surface, greater than the depth distance of the depression.

6 Claims, 10 Drawing Sheets

METHOD OF FABRICATING SHAFT FROM METAL PLATE

FIELD OF THE INVENTION

The present invention relates to a method of forming from a metallic plate a shaft that makes a single-piece construction with the foregoing metallic plate.

BACKGROUND OF THE INVENTION

When a shaft is provided on a metallic plate, it has been a usual practice to fix a shaft prepared separately on a metallic plate by caulking, spot welding and the like.

An explanation will be made below on the prior art methods for forming a shaft on a metallic plate.

FIG. 17 shows a prior art method for forming a shaft on a metallic plate by caulking.

A hole is formed on a metallic plate 10, on which a shaft 11 is to be attached, and the shaft 11 prepared separately is fixed on the metallic plate 10 by caulking.

FIG. 18 shows another prior art method for forming a shaft on a metallic plate by spot welding.

A shaft 13 prepared according to a separate process is fixed by spot welding on a metallic plate 12, on which the shaft 13 is to be mounted.

The Japanese patent gazette Heisei 6(1994)-26737 describes a method for forming an shaft as shown in FIG. 19, whereby, after a hole has been formed on one surface of a plate material 21 and a projection 24 on the other surface thereof by pressing forcefully a first tool 22 against the surface of the plate material 21 a bottom surface 23*a* of a second tool 23 is pressed forcefully against the foregoing hole, thereby a certain amount of material being pushed out to make the projection 24 further protrude and then the first tool 22 is again pressed against the hole to increase the height of the projection 24, thus completing the formation of a shaft.

In addition, it is known that there are a forward extrusion method as shown in FIG. 20 and a backward extrusion method as shown in FIG. 21 as the methods for making things in an axial shape.

However, the prior art method for forming shafts by caulking or spot welding as described in the above comprises the steps of preparing shafts separately and then fixing the shafts on a metallic plate with a resulting increase in cost.

Furthermore, in the case of caulking, the metallic plate involved is liable to be deformed due to the pressure applied by caulking and also it is rather difficult to achieve squareness between the metallic plate and the shaft that are to be put together, and in the case of spot welding, sufficient strength is unable to be gained due to a relatively small welding area, thus presenting rather a serious problem.

In the case of the method as described in the Japanese patent gazette Heisei 6(1994)-26737, since a pushing down force of tool is always applied to the boundary between a plate material and a projection, it is difficult to obtain a sufficient height of the projection and also it is difficult for the projection to achieve squareness against the plate material and accuracy in the outer diameter thereof with an additional problem of requiring many steps in processing.

Also, both the forward extrusion method and backward extrusion method are the methods intended for producing things in an axial shape from a material in pellet form and not for forming integrally a shaft by extruding from a flat plate.

SUMMARY OF THE INVENTION

The present invention deals with the problems involved with the prior arts as described in the above and discloses a method for forming a shaft comprising a first step of pressing a metallic plate to perform half blanking or forward squeezing and a second step of applying an extension to the foregoing projection in an axial shape by pushing a punch into the projection of the foregoing metallic plate obtained from the first step and held by a die and by rear-squeezing the foregoing projection in the direction opposite to the direction, in which the foregoing punch is pushed.

Further, the present invention is characterized by forming shafts of the same height located at a plurality of places simultaneously.

Still further, the present invention is characterized by performing consecutive processing in the second step to have the direction, in which the projection is extended to form a shaft, reversed from the direction, in which the metallic plate is pressed at a separate process.

Accordingly, since a projection is formed by applying a pressing process to a metallic plate in forward squeezing and then rear-squeezing is performed on the projection by the use of a punch and a die, shafts assured of having a length, accuracy in outer diameter, squareness and the like as required can be formed at arbitrary positions on a metallic plate integrally therewith and yet requiring only a small number of processing steps.

Also, since shafts with the same height are formed simultaneously at a plurality of places, a plurality of shafts with the same height can be made to increase the height thereof by rear-squeezing in the second step and even if the metallic plate is floating from the die surface, it is made possible to reduce variations in the magnitude of floating and prevent the metallic plate from slanting.

Furthermore, since the direction, in which a shaft is extended, is made reversed from the direction, in which a metallic plate is pressed at a separate process, there exist no gaps between the die surface and the metallic plate when rear-squeezing is performed in consecutive processing in the second step, thereby facilitating the pressing processes in other steps.

BRIEF DESCRIPTION OF THE DRAWINGS

FIG. 5(*b*) is a diagram to show the volume of the shaft.

FIG. 15(*b*) is a diagram to explain the case, wherein the direction of a shaft extended is opposite to the direction of pressing process performed separately in the consecutive processing.

PREFERRED EMBODIMENTS OF THE INVENTION

Some of the exemplary embodiments of the present invention will be explained below with reference to drawings.

Figure 1:
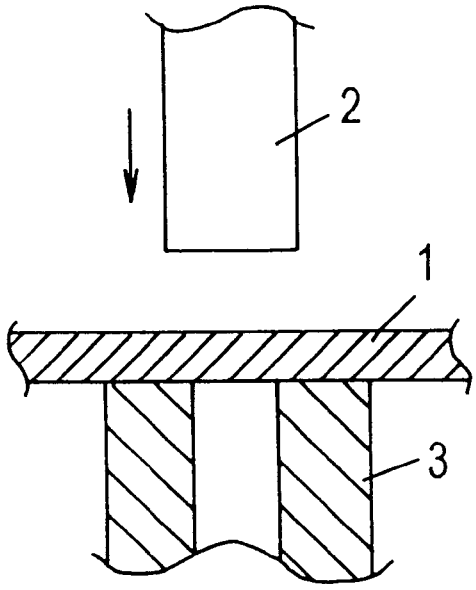
FIG. 1 is a diagram to show the state before a first step of the method for forming a shaft from a metallic plate in an exemplary embodiment of the present invention.

In FIG. 1, the reference numeral 1 shows a metallic plate, where a shaft is formed by extrusion, the reference numeral 2 shows a punch to perform with the use of a press of a half blanking against the metallic plate 1 or forward squeezing, whereby a movement of a material constituting the metallic plate 1 is made in the same direction as the movement of the punch 2, and the reference numeral 3 shows a die that is used together with the punch 2 when the half blanking or forward squeezing of the metallic plate 1 is performed.

Figure 2:
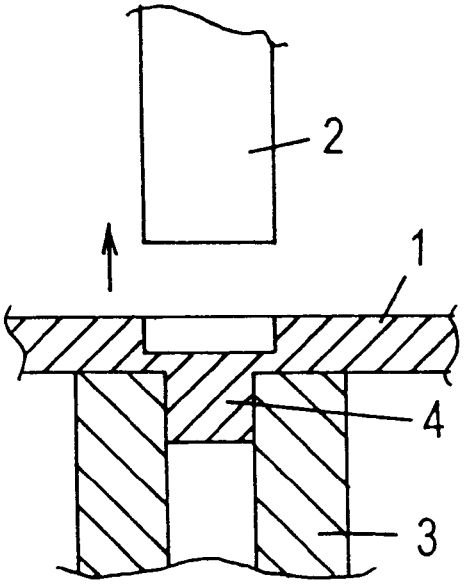
FIG. 2 is a diagram to show the state, wherein a projection has been formed in the first step.

In FIG. 2, the reference numeral 4 shows a projection formed on the metallic plate 1 by a half extrusion or forward squeezing.

Figure 3:
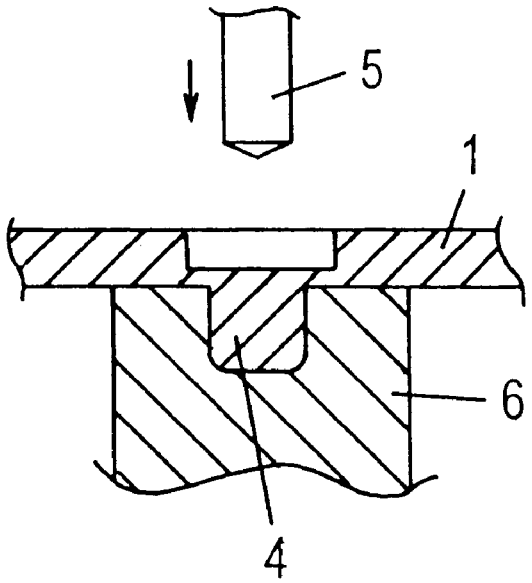
FIG. 3 is a diagram to show the relationship between a punch, die and metallic plate in a second step.

In FIG. 3, the reference numeral 5 shows a punch that is used in rear-squeezing of a material constituting the projection 4 and the reference numeral 6 shows a die used in rear-squeezing of the projection 4 together with the punch 5.

Figure 4:
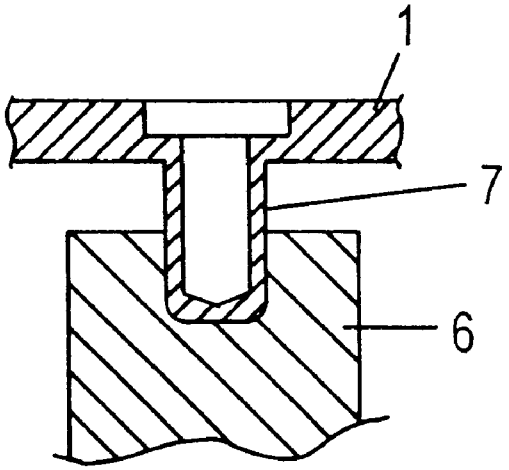
FIG. 4 is a diagram to show the state after the completion of the second step.

In FIG. 4, the reference numeral 7 shows a shaft formed integrally with the metallic plate 1 by rear-squeezing.

Next, an explanation will be made on the steps designed as described in the above, whereby a shaft formed integrally with a metallic plate 1 is produced.

First, a material in a volume required to have a shaft 7 formed is half blanked or forward squeezed by a press with the use of a punch 2. Then, a projection 4 formed on the metallic plate 1 by the half blanking or forward squeezing is compressed by the use of a punch 5 and die 6, and a shaft 7 is produced by rear-squeezing. At this time, the material of the projection 4 is transformed to the shaft 7 and the shaft 7 is expanded in the direction of the movement of the punch 5, thereby causing the metallic plate 1 to be lifted from the upper surface of the die 6 as shown in FIG. 4.

Figure 5A:
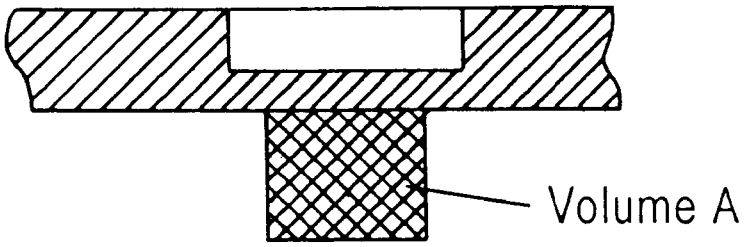
FIG. 5(*a*) is a diagram to show the volume of the projection.
Figure 5B:
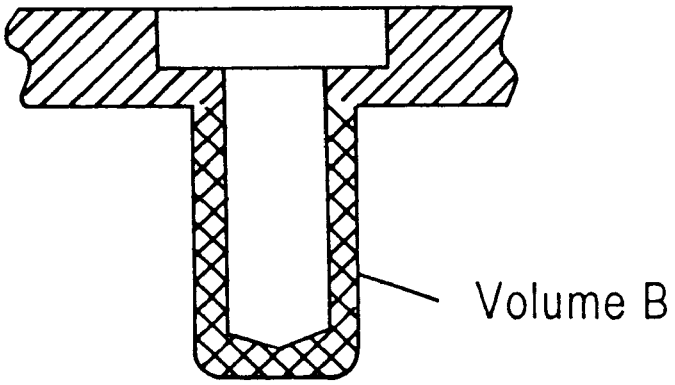

In a series of the steps as described in the above, the forward squeezing step requires a certain volume of material needed to form a shaft to be extruded by forward squeezing as shown in FIG. 5(*a*) and FIG. 5(*b*). In this forward squeezing step, the diameter of a punch and the extent of pressing are decided according to the height of a pin when a die with the same diameter as that of the pin is used.

At this time, when the height of the pin is small, the volume of extrusion provided by the forward squeezing is ended up with only a small volume and the diameter of the punch can be the same as that of the die. This is because the volume of extrusion becomes the same as that of pressing performed by the punch. As the height of the pin becomes large, the volume of extrusion also becomes large, thereby requiring the use of a punch with a larger diameter than the diameter of the die.

However, the extent of pressing performed by the punch at this time does not equal to the extent of extrusion. There always exists an escape of material.

Figures 6, 6A:
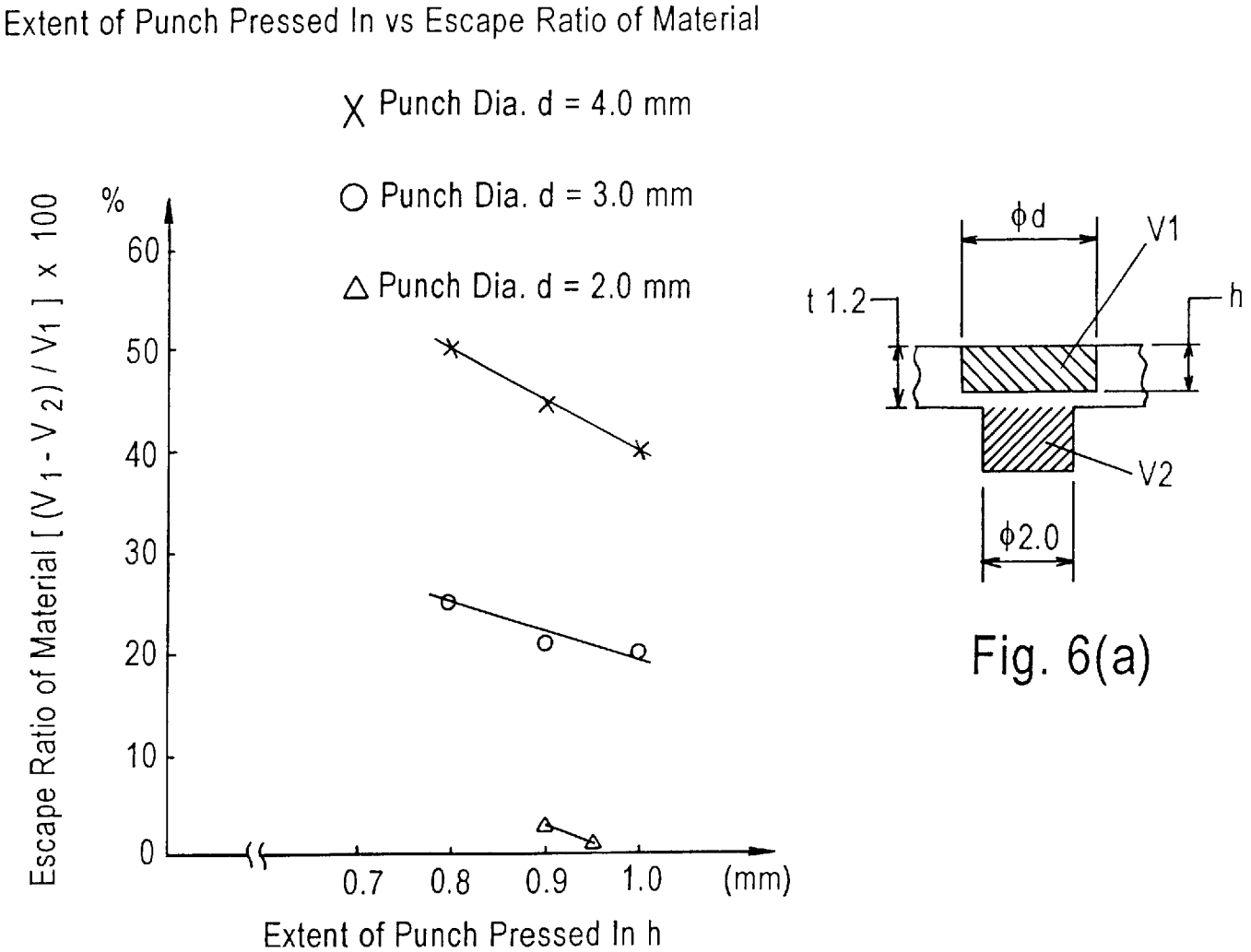
FIG. 6 is a diagram to show the relationship between an extent of the punch pushed in and an escape ratio of a SPCC material.
Figure 7:
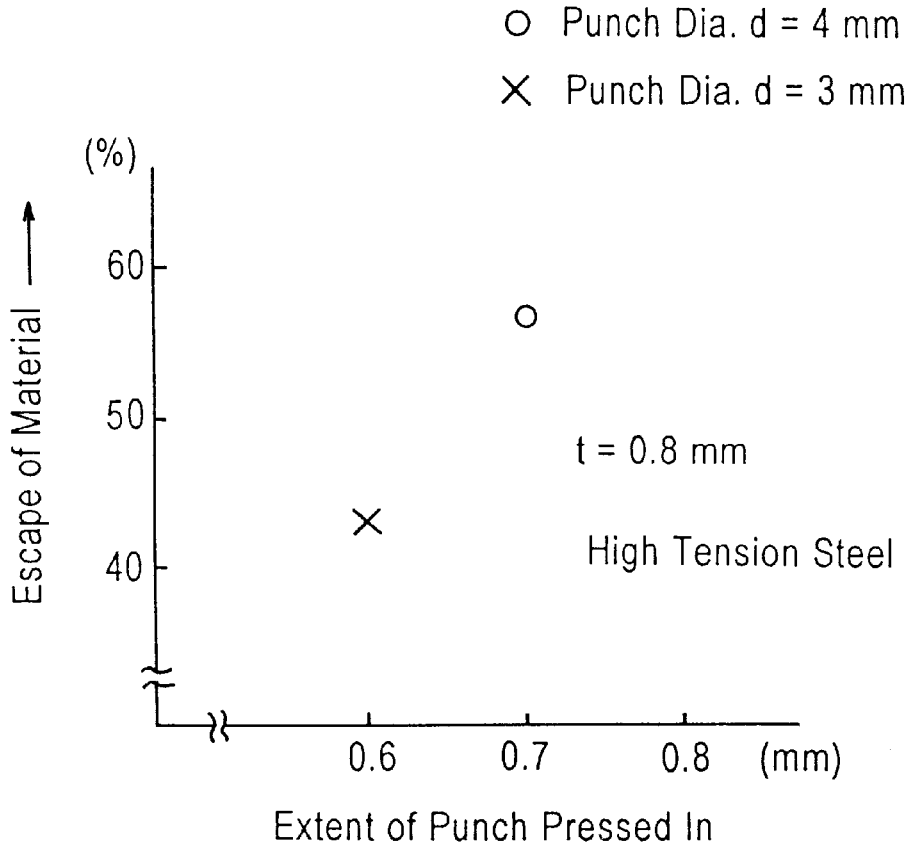
FIG. 7 is a diagram to show the relationship between an extent of the punch pushed in and an escape ratio of a high tension steel material.

FIG. 6 shows the amount of escape of material in case of a SPCC material with t=1.2 mm and FIG. 7 shows the amount of escape of material in case of a high tension steel with t=0.8 mm. The diameter of the die used is 2 mm.

It is learned to know from FIG. 6 that the escape amount of material increases as the diameter of punch becomes larger. It is understood that when the diameter of punch reaches 4 mm, about one half of the amount of material pressed in escapes to the surroundings. As far as the same punch having a certain diameter is used, as the amount of material pressed in increases the escape amount of material decreases.

According to these data, the diameter of a punch and the amount of material pressed in needed for pin forming are determined.

Then, the projection 4 of material formed by forward squeezing is inserted into the die 6 and crashed by a pressing force applied by the punch 5, which forms a rear-squeezing process, thus the shaft 7 being produced.

Figure 8:
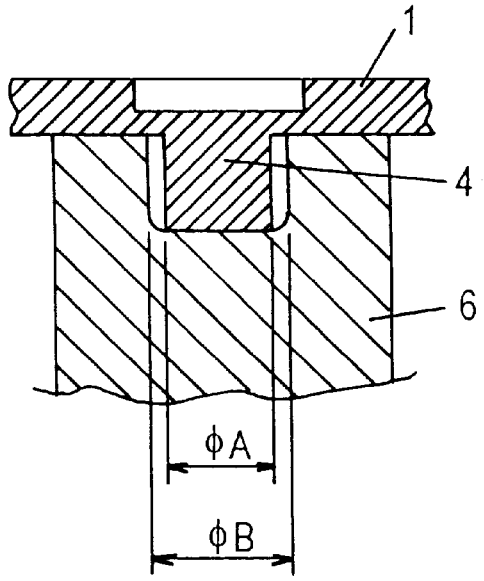
FIG. 8 is a diagram to show the relationship between the outer diameter of the projection of the metallic plate and the inner diameter of the die.

At this time, it is preferred that the diameter A of the projection 4 of material is made smaller than the diameter B of the die 6 as shown in FIG. 8 in order for the projection 4 of material to be readily inserted into the die 6 because the diameter of the die 6 has to be the same as the diameter of the shaft 7. In the initial experiment, the diameter of the projection was made smaller than that of the die for rear-squeezing by 0.01 mm. However, this arrangement is not suitable for consecutive processing since a force is needed for insertion into the die. When an experiment was performed with a projection that was smaller in diameter by 0.05 mm, the insertion into the die was able to be made so smoothly. Therefore, it is important for the diameter of forward squeezing die to be made smaller than that of the shaft by 0.01 mm or more to about 0.1 mm and most preferably by 0.05 mm when pin forming is carried out by the use of a consecutive die.

The secret of successful rear-squeezing is to make the tip of the punch tapered for a smooth flow of material.

Further, since the metallic plate is lifted from the upper surface of the die, the material should not be pressed down by the use of a stripper plate.

Figure 9:
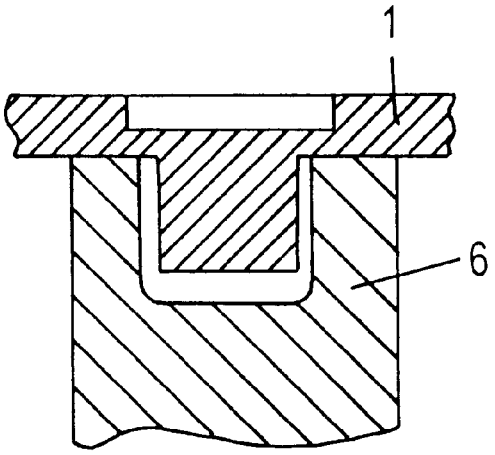
FIG. 9 is a diagram to show the relationship between the height of the projection of the metallic plate and the depth of the die.

In addition, when the projection 4 of the metallic plate 1 is inserted into the die 6 and there is a gap between the upper surface of the die 6 and the metallic plate 1, a step is formed at the root of the shaft. In order to prevent this, the depth of the die 6 is made larger than the height of the projection 4 of material by 0.05 to 0.1 mm as shown in FIG. 9.

As a specific example of the above, a projection of 1.99 mm in diameter and 3.4 mm in height was formed on a metallic plate 1 of an SPCC material with the plate thickness t=1.2 mm.

Figure 10:
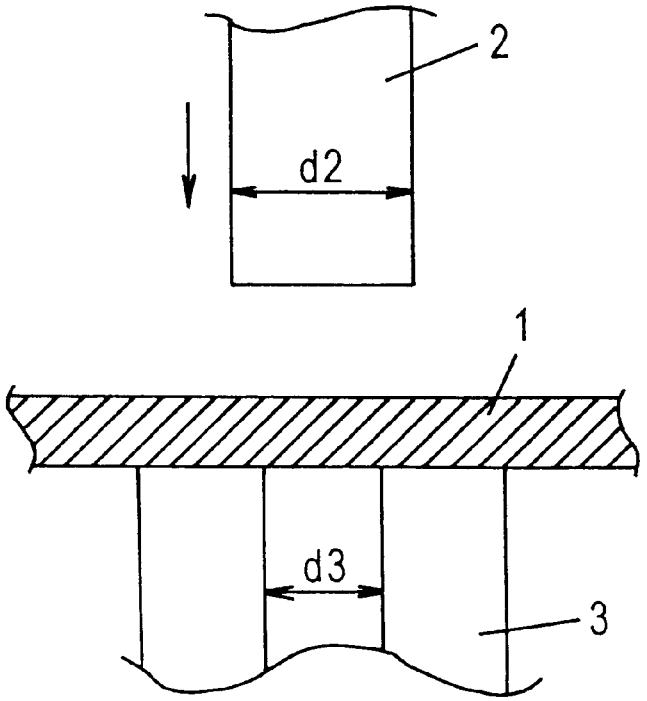
FIG. 10 is a diagram to show the dimensional relationship between the punch and the die in the first step.

In this case, as shown in FIG. 10, the punch 2 used in forward squeezing had a diameter $d_2$ of 3.0 mm and the die 3 had an inner diameter $d_3$ of 1.94 mm.

Figure 11:
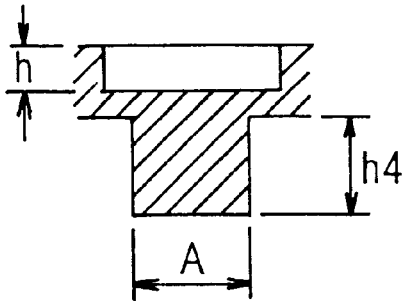
FIG. 11 is a diagram to show the relationship between an extent of the punch pushed in and a height of the projection in the first step.

The dimensions of various parts of the material that includes the projection 4 thus produced by the forward squeezing as shown in FIG. 11 are the extent h of punch pressing is 1.0 mm, the diameter A of the projection 4 is 1.93 mm and the height $h_4$ is 1.87 mm.

Figure 12:
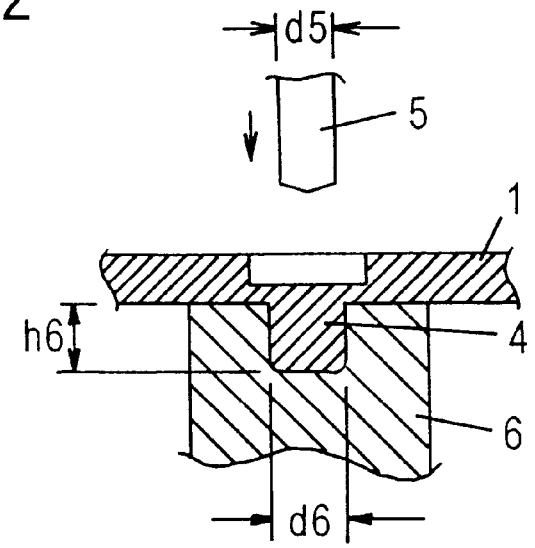
FIG. 12 is a diagram to show the dimensional relationship between the punch and the die in the second step.
Figure 13:
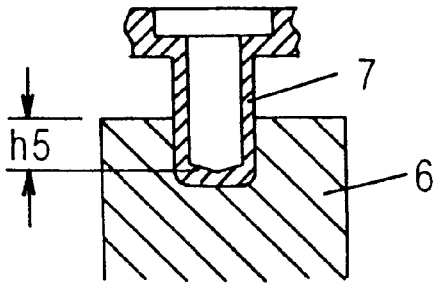
FIG. 13 is a diagram to show an extent of the punch pushed in in the second step.

Further, in the rear-squeezing of the projection 4 as shown in FIG. 12, the diameter $d_5$ of the punch 5 is 1.4 mm, the inner diameter $d_6$ of the die 6 is 1.99 mm and the depth $h_6$ of the die 6 is 1.90 mm. In addition, the extent $h_5$ of punch 5 pressing in as shown in FIG. 13 is 1.65 mm.

Figure 14:
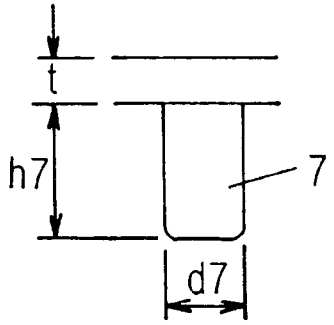
FIG. 14 is a diagram to show the dimensions of a shaft after completion of processing.

As a result, the dimensions of various parts of the shaft 7 as shown in FIG. 14 are the plate thickness t is 1.2 mm, the height $h_7$ ranges from 3.367 to 3.432 mm and the diameter $d_7$ ranges from 1.983 to 1.992 mm. Variations in height and diameter are 0.07 mm and 0.01 mm, respectively, and a slant of the tip of shaft ranges from 0.00 to 0.05 mm.

The secrets of achieving a larger height for the shaft in forward squeezing are to have the material projected in abundance and to make the thickness of pin's side walls small. The result of efforts to find out the limitation on the foregoing height is as follows:

An SPCC material with t=1.2 mm is used and the diameter of the punch used in forward squeezing is 4 mm.

Use of a 5 mm dia. punch allows fairly large amount of material to escape, thereby causing a bulge to be created at the root of the projection.

When an experiment was performed with the pin's side walls made 0.01 mm in thickness, the pin was broken at the root thereof due to an insufficient strength. Therefore, the wall thickness of the pin has been increased to 0.2 mm, resulting in a height of the pin measuring 5.95 mm.

According to the exemplified embodiments as described in the above, what follows has been found out.

In connection with falling of the pin, not much falling has been observed this time since a shaft of 2 mm in diameter was formed on a flat plate of 40 mm by 40 mm. However, in case where a material with a larger area is used, jumping of the pin may occur due to the floating of the material at the time of rear-squeezing, thereby causing the pin to fall down. Therefore, it is needed to arrange shafts at several places in order for the material to bounce in a good balance.

With regard to the rear-squeezing process, when rear-squeezing is performed, the material bounces but the extent of pouncing varies according to the height of shafts. Therefore, during the same process of rear-squeezing, forming of shafts with only one height is possible. Further, this process is unable to accommodate other processes (stamping, bending and the like) and it is better not to have pilots and the like that may obstruct the bouncing of material.

Figure 15A:
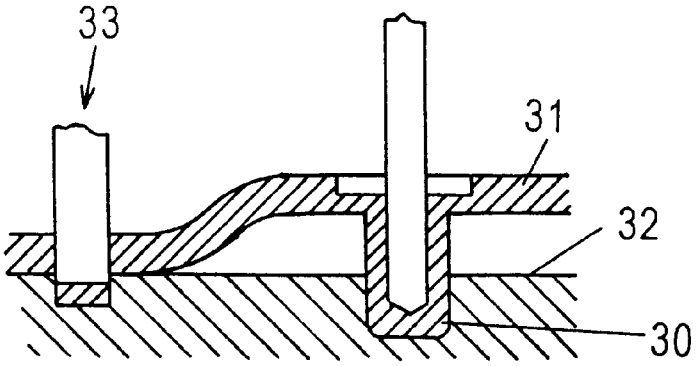
FIG. 15(*a*) is a diagram to explain the case, wherein the direction of a shaft extended is the same as the direction of pressing process performed separately in the consecutive processing.
Figure 15B:
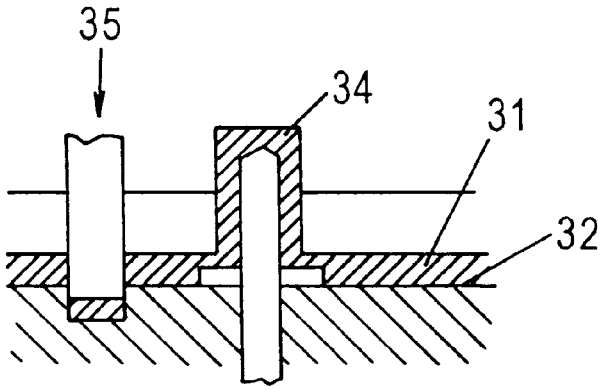

Furthermore, when the rear-squeezing process is performed consecutively, a restriction is imposed on the direction of shaft. In case wherein a shaft 30 with a downward direction is formed as shown in FIG. 15(*a*), a gap is created between the die surface 32 and the material 31 because the material 31 bounces upward, resulting in the formation of warpage in the material 31 when processing of extrusion and the like are performed in another process 33. Conversely, when a shaft 34 with an upward direction is formed, no gaps are created between the die surface 32 and the material 31 since the material 31 is pressed downward as shown in FIG. 15(*b*), thereby facilitating the extrusion processing in another process 35.

Figure 16:
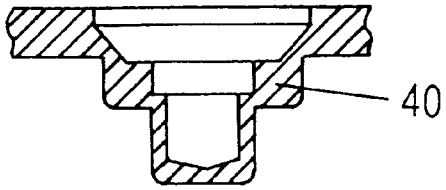
FIG. 16 is a diagram to show the state of a stepped shaft under processing.
Figure 17:
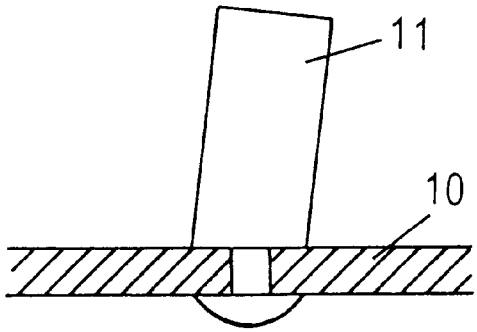
Fig. 17 (PRIOR ART)
FIG. 17 is a diagram to show a prior art method for fixing a shaft by caulking.
Figure 18:
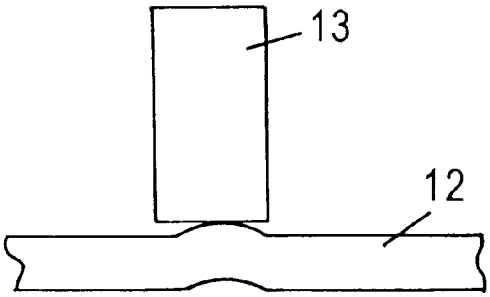
Fig. 18 (PRIOR ART)
FIG. 18 is a diagram to show a prior art method for fixing a shaft by spot welding.
Figure 19:
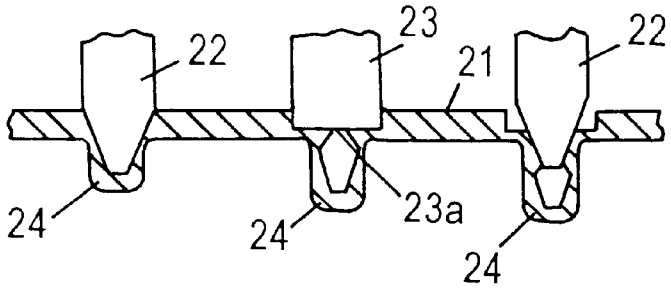
Fig. 19 (PRIOR ART)
FIG. 19 is a diagram to show a prior art method for forming shafts already publicly known.
Figure 20:
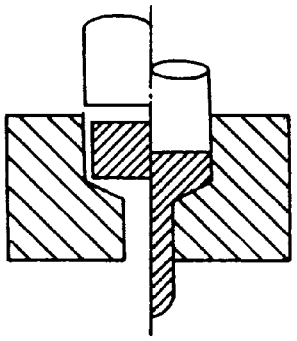
Fig. 20 (PRIOR ART)
FIG. 20 is a diagram to explain a forward extrusion method.
Figure 21:
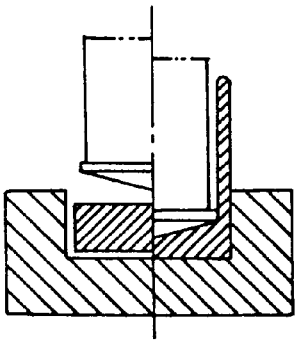
Fig. 21 (PRIOR ART)
FIG. 21 is a diagram to explain a backward extrusion method.

Moreover, by applying additional processing to the shaft 7 produced in the present exemplary embodiment, it is also possible to form a shaft provided with a step 40 as shown in FIG. 16.

INDUSTRIAL APPLICABILITY

As described in the above, the present invention discloses an extremely effective method for forming a shaft on a metallic plate integrally therewith at an arbitrary position on the metallic plate in such a way as assuring sufficiently the length, precision of outer diameter, squareness and the like, requiring only a small number of processing steps, since the shaft is formed by applying rear-squeezing by use of a punch or die to a projection that has been formed beforehand by pressing the metallic plate to perform forward squeezing.

Also, by simultaneously forming shafts, each having the same height as others, at a plurality of positions, the plurality of the same height shafts are extended in length by rear-squeezing that serves as a second step of processing, thereby preventing the variation in the amount of lifting and slanting of the metallic plate even if the metallic plate happens to be lifted away from the die surface.

Furthermore, by having the direction of shafts extension performed in the second step of processing and the direction of extrusion processing applied to the metallic plate in another step of processing reversed from each other, no gaps are created between the die surface and the metallic plate even at the time of rear-squeezing performed consecutively, thereby facilitating the punching-through process performed at another step of processing.

We claim:

1. A method of forming an axial projection on a metallic plate comprising:

placing a first surface of the metallic plate on a first die having a first diameter opening;

pressing a second surface of the metallic plate, opposing the first surface, with a first punch to form a projection from the first surface via half blanking or forward squeezing, said projection having a tip surface extending into the first diameter opening a first distance from the first surface;

placing the first surface of the metallic plate on a second die having a depression with the projection extending into said depression, said depression having a second diameter greater than the first diameter and a depth distance greater than the first distance; and pressing the second surface of the metallic plate with a second punch having a smaller diameter than the first diameter causing the tip surface of the projection to contact a bottom surface of said depression and form the axial projection via rear-squeezing, said axial projection having a tip surface extending a second distance from the first surface, greater than the depth distance of said depression.

2. The method of claim 1, wherein said second diameter is greater than a the first diameter by a magnitude ranging from 0.01 mm to 0.1 mm.

3. The method of claim 1, wherein the depth distance of the second die is greater than the first distance by a magnitude ranging from 0.05 mm to 0.1 mm.

4. The method of claim 1, wherein said second punch has a tapered tip.

5. The method of claim 1, wherein a plurality of axial projections are simultaneously formed at a plurality of different positions of said metallic plate.

6. The method of claim 1, wherein said metallic plate is subjected to consecutive processings and one of the consecutive processings presses said first surface of the metallic plate to form an extrusion extending from said second surface.

* * * * *